US010478877B2

(12) United States Patent
Saito

(10) Patent No.: US 10,478,877 B2
(45) Date of Patent: Nov. 19, 2019

(54) DIE FOR DRAWING METAL WIRE ROD, AND METHOD FOR MANUFACTURING SAME

(71) Applicant: BRIDGESTONE CORPORATION, Tokyo (JP)

(72) Inventor: Takayuki Saito, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 402 days.

(21) Appl. No.: 15/304,608

(22) PCT Filed: Mar. 25, 2015

(86) PCT No.: PCT/JP2015/059253

§ 371 (c)(1),
(2) Date: Oct. 17, 2016

(87) PCT Pub. No.: WO2015/159675

PCT Pub. Date: Oct. 22, 2015

(65) Prior Publication Data

US 2017/0056946 A1 Mar. 2, 2017

(30) Foreign Application Priority Data

Apr. 18, 2014 (JP) ..... 2014-086707

(51) Int. Cl.
*B21C 3/02* (2006.01)
*B21C 1/02* (2006.01)

(52) U.S. Cl.
CPC . *B21C 3/02* (2013.01); *B21C 1/02* (2013.01)

(58) Field of Classification Search
CPC .... B21C 1/00; B21C 3/00; B21C 3/02; B21C 3/025; B21C 3/04; B21C 1/02
See application file for complete search history.

(56) References Cited

U.S. PATENT DOCUMENTS 4,051,706 A * 10/1977 Sakamoto ..... C22C 28/00 148/120
4,270,373 A * 6/1981 Hirato ..... B21C 9/00 72/41

(Continued)

FOREIGN PATENT DOCUMENTS

CN 1651161 A 8/2005
CN 201076874 Y 6/2008

(Continued)

OTHER PUBLICATIONS

Translation, JP 2012-111663A, Jun. 2012.*
Translation, DE 10211539A1, Oct. 2002.*
Translation, JP 02-255213A, Oct. 1990.*

(Continued)

*Primary Examiner* — Edward T Tolan
(74) *Attorney, Agent, or Firm* — Sughrue Mion, PLLC

(57) ABSTRACT

Provided are a metal wire rod drawing die that has a longer life than conventional dies and that can prevent damage to a metal wire rod surface and a method for manufacturing the die. In a metal wire rod drawing die (1), a die hole (2) for inserting a metal wire rod is formed. Where Ra1 represents a surface roughness of an inner surface of the die hole from a bearing section (2*b*) to an approach section (2*a*) corresponding to an area reduction rate of 30% in an axial direction of the die hole, Ra2 represents a surface roughness of the inner surface of the die hole from the bearing section to the approach section corresponding to the area reduction rate of 30% in a direction orthogonal to the axial direction of the die hole, and Ra3 represents a surface roughness of an inner surface of the bearing section of the die hole in the axial direction of the die hole, the Ra1, the Ra2, and the Ra3 satisfy a relationship represented by 0.14 μm>Ra2>Ra1>Ra3.

4 Claims, 2 Drawing Sheets

(56) References Cited

U.S. PATENT DOCUMENTS

| | | | | |
|---|---|---|---|---|
| 7,401,486 | B2 * | 7/2008 | Okui | B21C 3/04 72/253.1 |
| 2005/0281496 | A1 * | 12/2005 | Takahashi | F16O 29/065 384/13 |
| 2009/0314050 | A1 * | 12/2009 | Choe | B21C 3/00 72/467 |
| 2010/0043520 | A1 | 2/2010 | Sumiya et al. | |

FOREIGN PATENT DOCUMENTS

| | | | | | |
|---|---|---|---|---|---|
| CN | 202845479 | U | | 4/2013 | |
| CN | 202877261 | U | | 4/2013 | |
| DE | 39 03 398 | A1 | | 8/1990 | |
| DE | 10211539 | A1 | * | 10/2002 | B21C 3/00 |
| JP | 02-255213 | A | | 10/1990 | |
| JP | 11-57843 | A | | 3/1999 | |
| JP | 2009-22973 | A | * | 2/2009 | B21H 8/00 |
| JP | 2012-111663 | A | * | 6/2012 | C03B 11/00 |
| JP | 2012-187594 | A | | 10/2012 | |
| WO | 2008/088048 | A1 | | 7/2008 | |

OTHER PUBLICATIONS

Communication dated Apr. 3, 2017, issued by the European Patent Office in corresponding European Application No. 15779255.7.

Communication dated Oct. 10, 2017 from the State Intellectual Property Office of the P.R.C., in counterpart Chinese application No. 201580020420.9.

International Search Report of PCT/JP2015/059253 dated Jun. 16, 2015.

* cited by examiner

DIE FOR DRAWING METAL WIRE ROD, AND METHOD FOR MANUFACTURING SAME

TECHNICAL FIELD

The present invention relates to a metal wire rod drawing die (hereinafter also referred to simply as "die") and a method for manufacturing the die, and in particular, to a metal wire rod drawing die that has a longer life than conventional dies and that can prevent damage to a metal wire rod surface and a method for manufacturing the die.

BACKGROUND ART

For metal wire rod drawing dies, cemented carbide is commonly used that has high hardness and has excellent abrasion resistance and impact resistance. Cemented carbide is produced by sintering hard particles of tungsten carbide (WC), titanium carbide (TiC), or the like with a binder of an iron group metal such as cobalt (Co or nickel (Ni). The most common cemented carbide is an alloy containing WC as hard particles and Co as a binder, and dies made of a cemented carbide that has the composition are used for metal wire rod drawing.

A die is usually manufactured by undergoing a sizing step of polishing the inner surface of a prepared hole of a new die with the prepared hole formed therein or a used die as a primary material to form a die hole having a predetermined diameter. Today, polishing of the inner surface of a die hole is performed by inserting a polishing needle in the die hole while rotating the die and the polishing needle (e.g., Patent Document 1).

RELATED ART DOCUMENT

Patent Document

Patent Document 1: Japanese Unexamined Patent Application Publication No. H1 1-57843

SUMMARY OF THE INVENTION

Problems to be Solved by the Invention

However, attempts to enhance the strength of a metal wire rod to be drawn and to perform high-speed wire drawing can cause problems such as early abrasion of a die. For example, high-speed wire drawing requires addressing problems that: (i) early abrasion of a die is serious, which shortens the life of the die; (ii) the surface of a drawn wire rod becomes rough and damage occurs; and (iii) after wire drawing, the amount of a lubrication component remaining on a wire rod surface is reduced, lowering lubricity in wire drawing. Boronizing for improving abrasion resistance is an option for deal with such problems. However, mere improvements in boronizing conditions and the like are not necessarily enough, and additional measures are needed.

Accordingly, it is an object of the present invention to provide a metal wire rod drawing die that has a longer life than conventional dies and that can prevent damage to a metal wire rod surface and a method for manufacturing the die.

Means for Solving the Problems

The present inventor has conducted intensive and extensive studies and consequently found that the hole of a new die has a damage caused during the polishing process in a direction intersecting with an axial direction of the hole, and such a polishing damage causes the above problems. Thus, by setting the surface roughness Ra of the inner surface of the die hole as follows, the inventor has succeeded in reducing damage to a metal wire rod surface along with favorable extension of the life of the die, thereby completing the invention.

Specifically, a metal wire rod drawing die of the present invention is a metal wire rod drawing die with a die hole formed therein for inserting a metal wire rod.

the die being characterized in that the die hole includes an approach section tapered in a direction in which the metal wire rod is inserted and a bearing section having a constant inner diameter located at a subsequent stage to the approach section; and where Ra1 represents a surface roughness of an inner surface of the die hole from the bearing section to the approach section corresponding to an area reduction rate of 30% in an axial direction of the die hole, Ra2 represents a surface roughness of the inner surface of tie die hole from the bearing section to the approach section corresponding to the area reduction rate of 30% in a direction orthogonal to the axial direction of the die hole, and Ra3 represents a surface roughness of an inner surface of the bearing section of the die hole in the axial direction of the die hole, the Ra1, the Ra2, and the Ra3 satisfy a relationship represented by the following formula:

0.14 μm>Ra2>Ra1>Ra3. Herein, the surface roughness Ra refers to an arithmetic mean roughness (whose unit is "μm") measured in accordance with JIS B0601.

A method for manufacturing a metal wire rod drawing die of the present invention is a method for manufacturing the metal wire rod drawing die of the invention described above, the method being characterized by including a sizing step of polishing the inner surface of the die hole for inserting a metal wire rod to a predetermined diameter and a polishing step of polishing the inner surface of the die hole by abrasive flow machining after the sizing step.

Effects of the Invention

According to the present invention, there is provided a metal wire rod drawing die that has a longer life than conventional dies and that can prevent damage to a metal wire rod surface and a method for manufacturing the die.

MODE FOR CARRYING OUT THE INVENTION

Hereinafter, embodiments of the present invention will be described in detail by using the drawings.

Figure 1A:
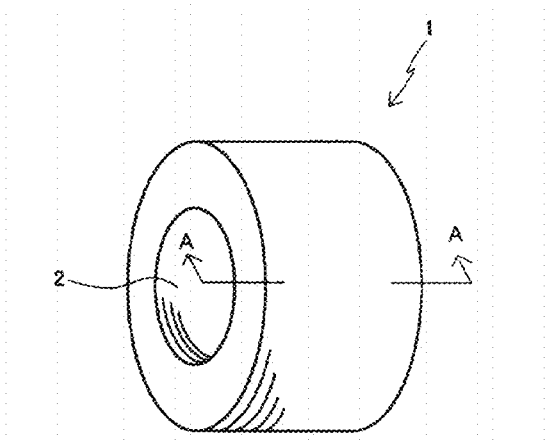
FIG. 1A is a perspective view of a die according to one suitable embodiment of the present invention.
Figure 1B:
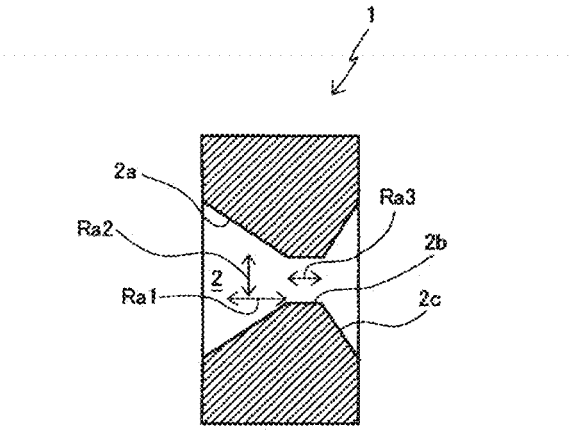
FIG. 1B is a cross-sectional view of the die in a direction along line A-A of FIG. 1A.

FIG. 1A is a perspective view of a die according to one suitable embodiment of the invention, and FIG. 1B is a cross-sectional view of the die in a direction along line A-A of FIG. 1A. In the illustrated example, a die 1 has a cylindrical outer shape, and substantially at a center thereof is provided a die hole 2 for inserting a metal wire rod. As depicted in FIG. 1B, the die hole 2 includes an approach section 2*a* formed to be tapered toward an exit direction for a wire rod to be drawn, a bearing section 2*b* having a constant inner diameter located at a subsequent stage of the approach section 2*a*, and a release section 2*c* having an inner diameter enlarged toward the exit direction at a subsequent stage of the bearing section 2*b*. In the approach section 2*a* is provided a predetermined tapered angle. A metal wire rod is fed in from an approach section 2*a* side, and drawn toward the bearing section 2*b*. At this time, the diameter of the metal wire rod is drawn-squeezed by tapering of the approach section 2*a*, thereby performing wire drawing.

In the metal wire rod drawing die of the invention, where a1 represents a surface roughness of an inner surface from the bearing section 2*b* to the approach section 2*a* corresponding to an area reduction rate of 30% in an axial direction of the die hole 2, a2 represents a surface roughness of the inner surface of the die hole 2 from the bearing section 2*b* to the approach section 2*a* corresponding to the area reduction rate of 30% in a direction orthogonal to the axial direction, and a3 represents a surface roughness of an inner surface the bearing section 2*b* of the die hole 2 in the axial direction of the die hole 2, the a1, the a2, and the a3 satisfy a relationship represented by the following formula:

$$0.13\ \mu m > Ra2 > Ra1 > Ra3.$$

In FIG. 1B, arrows of Ra1, Ra2, and Ra3 indicate directions of the respective surface roughnesses.

When the Ra2 is less than 0.14 μm, the inner surface of the approach section 2*a* in the direction orthogonal to the axial direction of the hole is sufficiently smoothed. Thus, the flow resistance of a lubricant in the die hole is reduced, and the frictional resistance of the metal wire rod in the direction of wire drawing is reduced. Accordingly, damage to a metal wire rod surface can be reduced. Additionally, the reduced flow resistance of the lubricant reduces the frictional resistance of the metal wire rod. Due to that, early abrasion of the die is reduced, so that the life of the die can be improved. In addition, by making the a2 in the wire rod insertion direction of the metal wire rod, i.e., the Ra1 smaller than the Ra2, the frictional resistance of the metal wire rod can be further reduced. In addition, when the metal wire rod is inserted, the Ra3 of the bearing section b determines smoothness of the surface of the metal wire rod to be finished. Thus, the Ra of this section is made the smallest, i.e., Ra1>Ra3. Particularly, the surface roughness Ra2 in the direction orthogonal to the axial direction of the die hole 2 is suitably equal to or less than 0.11 μm.

The die 1 of the invention is required to have characteristics of being hard and hardly abrasive, and therefore is preferably made of a cemented carbide produced by sintering a powder of a hard carbide or nitride with a powder of a soft metal as a binder. Examples of hard carbides and nitrides include WC, VC, TiC, TaC, NbC, $Cr_3C_2$, $Mo_2C$, VC, and TiN as unary systems, and WC—TiC, TiC—TiN, WC—TiC—TaC (NbC), and WC—TiC—TiN as pseudo-binary or pseudo-ternary systems. On the other hand, as the soft metal serving as the binder, besides Co, Ni, Co—Ni, Ni—Fe, or the like can be used. Preferred is a die that includes WC as hard particles and Co as the binder.

The die 1 of the invention has no particular limitation other than to satisfy the relationship represented by 0.14 μm>Ra2>Ra1>Ra3. The die 1 of the invention is used for metal wire rod drawing. Examples of a metal wire rod to be drawn include a steel wire, a stainless steel wire, and a high carbon steel wire, and the surfaces of these wires may be those that have been subjected to a plating process or the like.

Next will be described a method for manufacturing a metal wire rod drawing die of the invention.

In general, a metal wire rod drawing die is manufactured by undergoing a sizing step of polishing a die hole of a new die with the die hole for inserting a metal wire rod formed therein or a die hole of a used die. The method for manufacturing a metal wire rod drawing die of the invention is a method for manufacturing the metal wire rod drawing die of the invention described above, and includes a sizing step of polishing the inner surface of the die hole for inserting a metal wire rod to a predetermined diameter and a polishing step of polishing the inner surface of the die hole by abrasive flow machining after the sizing step. Thereby, the flow resistance of a lubricant in the die hole is reduced and therefore the abrasion resist, of the metal wire rod in a wire drawing direction can be reduced, so that damage to a metal wire rod surface can be reduced. In addition, abrasion of the die is reduced, and thus the life of the die can also be improved.

Abrasive flow machining is a surface polishing method using a viscoelastic fluid, which is referred to as polishing medium, prepared by nixing and kneading abrasive grains, and is a method of performing processing by causing the polishing medium to flow in a die hole and press-moving the abrasive grains in the polishing medium to the inner surface of the die hole. Thus, when abrasive flow machining is performed on the inner surface of the die hole 2, polishing of the bearing section 2*b* is performed under higher polishing pressure, whereby the Ra3 becomes smaller than the Ra1. Additionally, since abrasive flow machining allows the polishing medium to reciprocate in the die hole under a predetermined pressure, the Ra1 becomes smaller than the Ra2. Accordingly, by performing abrasive flow machining on the inner surface of the die hole 2 until the Ra2 becomes less than 0.14 μm, a metal wire rod drawing die can be obtained that satisfies the following formula:

$$0.14\ \mu m > Ra2 > Ra1 > Ra3.$$

Additionally, in conventional polishing methods, the Ra2 can be made equal to or less than 0.14 μm by making small the particle diameter of diamond included in the polishing needle, but the relationship of Ra2>Ra1>Ra3 cannot be satisfied.

As for the abrasive grains of the polishing medium used in the method for manufacturing the die of the invention, silicon carbide, aluminum oxide, diamond, or the like may be used. Additionally, abrasive grains having a particle diameter of, for example, about from 10 to 80 μm can be used, where a particle diameter according to the hole diameter of a die hole to be intended may be selected as appropriate. The shape of the abrasive grains is also not particularly limited, and examples thereof include spherical, indefinite, flat, and dish-like shapes. Preferred is a spherical shape. For example, in the method for manufacturing the die of the invention, a diamond powder having a particle diameter of about 30 μm can be suitably used as abrasive grains. In addition, the viscoelastic fluid of the polishing medium is not particularly limited, and any viscoelastic material conventionally used in abrasive flow machining can be used.

For example, in polishing using, as abrasive grains, a diamond powder having a particle diameter of 30 μm at a polishing pressure of 90±5 kgf/cm$^2$ (about 8.8 MPa), a polishing time of about 80 seconds may be used for a die hole having a narrow diameter, such as less than 0.2 mm, about 40 seconds for a die hole diameter of about 0.5 mm, and about 20 seconds for a large die hole diameter, such as equal to or more than 0.9 mm. In addition, the polishing pressure is not limited to the above range. Under high polishing pressure, the polishing time can be shortened, whereas variation in polishing between individual dies to be polished may become large.

The only important thing for the method for manufacturing the die of the invention is to include the sizing step of polishing the inner surface of a die hole for inserting a metal wire rod to a predetermined diameter and the polishing step of polishing the inner surface of the die hole by abrasive flow machining after the sizing step, There is no limitation other than that, and any well-known technique can be employed. For example, the polishing of the die hole in the sizing step may be performed by inserting a polishing needle in the die hole while rotating the die and the polishing needle, as in conventional techniques.

In addition, by performing a boronizing process after the polishing step, that is, undergoing a so-called boronizing process step thereafter, the hardness of a die hole surface may be enhanced so that abrasion resistance is improved. Additionally, the boronizing process can be performed by any well-known method. For example, boronizing can be performed by mixing boron carbide ($B_4C$) in liquid paraffin to make into a paste form, filling the obtained boron carbide-containing liquid paraffin into the die hole, and heating in an electric furnace or the like.

EXAMPLES

Hereinafter, the present invention will be described in more detail by using Examples.

Examples 1 to 3

Figure 2A:
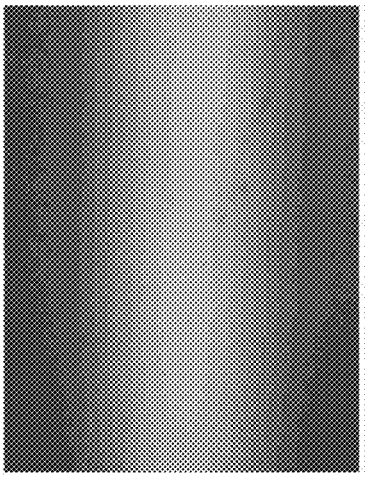
FIG. 2A is an electrophotograph of an approach section in the die hole of a die of Example 1.

As a sizing step, while rotating a die provided with a prepared hole and a polishing needle, a polishing needle was inserted into the die hole to polish respective die holes of three dies so that a machining margin in abrasive flow machining became about 3 μm. Next, as a polishing step, the die hole of each die polished by the polishing needle was polished using an abrasive flow machining device EX-800 model manufactured by Extrude Hone Co., Ltd. Each die obtained was cut into half along a longitudinal direction of the die, and the Ra1, the Ra2, and the Ra3 of the die hole after the abrasive flow machining were measured. In addition, using each die, wire drawing was performed on a metal wire rod to examine the life of each die. Table 1 depicts obtained results, and FIG. 2A depicts an electromicroscopic photograph of an approach section in a hole of the die of Example 1. The vertical direction of FIG. 2A is the axial direction. In addition, polishing of the die hole was performed by reciprocating an abrasion medium in the die hole at a pressure of 8.8 MPa. (90 kgf/cm$^2$). Details of the polishing medium are as follows:

Binder: silicone-based boride compound polymer

Polishing agent: black silicon carbide

Abrasive grains: diamond powder having a particle diameter of 30 μm

Release agent: lubricant material containing a mineral oil and a lubricant

Comparative Examples 1 to 5

Figure 2B:
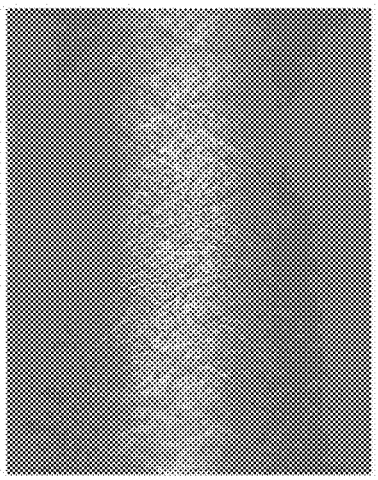
FIG. 2B is an electrophotograph of an approach section in the die hole of a die of Comparative Example 1.

While rotating a die provided with a prepared hole and a polishing needle, the polishing needle was inserted into the die hole to polish respective die holes of five dies so that a machining margin in abrasive flow machining became about 3 μm. In addition, in order to obtain a predetermined Ra distribution, the hardness and particle diameter of abrasive grains of the polishing needle were adjusted as appropriate. After that, without performing abrasive flow machining, obtained each die was cut into half along a longitudinal direction of the die, and the Ra1, the Ra2, and the Ra3 were measured. Additionally, using each die, wire drawing was performed on a metal wire rod to examine the life of the each die. Table 1 depicts obtained results. In addition, FIG. 2B depicts an electromicroscopic photograph of an approach section in the die hole of the die of Comparative Example 1. The vertical direction of FIG. 2B is the axial direction.

TABLE 1

| | Example 1 | Example 2 | Example 3 |
|---|---|---|---|
| Ra1 | 0.0575 | 0.0884 | 0.0554 |
| Ra2 | 0.1021 | 0.1382 | 0.1054 |
| Ra3 | 0.0199 | 0.0508 | 0.0178 |
| Life of die (amount of wire drawing (t)) | 5.3 | 4.2 | 6.0 |

TABLE 2

| | Comparative Example 1 | Comparative Example 2 | Comparative Example 3 | Comparative Example 4 | Comparative Example 5 |
|---|---|---|---|---|---|
| Ra1 | 0.1460 | 0.1448 | 0.1460 | 0.1012 | 0.0223 |
| Ra2 | 0.1432 | 0.1461 | 0.1482 | 0.0557 | 0.1011 |
| Ra3 | 0.1084 | 0.1072 | 0.1084 | 0.0212 | 0.0621 |
| Life of die (amount of wire drawing (t)) | 0.4 | 0.5 | 0.4 | 3.1 | 3.7 |

Table 1 showed that Examples 1 to 3 having performed abrasive flow machining on the approach section of the die hole satisfied the relationship of 0.14 μm>Ra2>Ra1>Ra3. On the other hand, Comparative Examples 1 to 5 having performed no abrasive flow machining on the approach section of the die hole all had a surface roughness Ra2 of equal to or more than 0.14 μm. In addition, it is shown that even in the amounts of metal wire rod drawing, the dies of Examples 1 to 3 are excellent as compared to the dies of Comparative Examples 1 to 5.

DESCRIPTION OF SYMBOLS

1 Die
2 Die hole
2*a* Approach section
2*b* Bearing section
2*c* Release section

The invention claimed is:

1. A metal wire rod drawing die with a die hole formed therein for inserting a metal wire rod, the die being characterized in that the die hole comprises an approach section tapered in a direction in which the metal wire rod is inserted and a bearing section having a constant inner diameter located at a subsequent stage to the approach section; and where Ra1 represents a surface roughness of an inner surface of the die hole from the bearing section to the approach section corresponding to an area reduction rate of 30% in an axial direction of the die hole, Ra2 represents a surface roughness of the inner surface of the die hole from the bearing section to the approach section corresponding to the area reduction rate of 30% in a direction orthogonal to the axial direction of the die hole, and Ra3 represents a surface roughness of an inner surface of the bearing section of the die hole in the axial direction of the die hole, the Ra1, the Ra2, and the Ra3 satisfy a relationship represented by the following formula:

$$0.14\ \mu m > Ra2 > Ra1 > Ra3.$$

2. A method for manufacturing the metal wire rod drawing die according to claim 1, the method being characterized by comprising a sizing step of polishing the inner surface of the die hole for inserting a metal wire rod to a predetermined diameter and a polishing step of polishing the inner surface of the die hole by abrasive flow machining after the sizing step.

3. A method for manufacturing the metal wire rod drawing die according to claim 1, wherein the Ra1, the Ra2, and the Ra3 satisfy a relationship represented by the following formula:

$$0.11\ \mu m > Ra2 > Ra1 > Ra3.$$

4. A method for manufacturing the metal wire rod drawing die according to claim 1, wherein the Ra1 and the Ra3 satisfy the following formula: Ra1≤0.0884 μm and Ra3≤0.0508 μm.

* * * * *